US007358487B2

(12) United States Patent
Ruiz-Alonso et al.

(10) Patent No.: US 7,358,487 B2
(45) Date of Patent: Apr. 15, 2008

(54) ION GATE

(75) Inventors: David Ruiz-Alonso, Cambridge (GB); Andrew Koehl, Cambridge (GB); Paul Boyle, London (GB); Martyn Rush, Cambridge (GB); Russell Parris, Cambridge (GB); Ashley Wilks, Cambridge (GB)

(73) Assignee: Owlstone Nanotech, Inc., New York, NY (US)

( * ) Notice: Subject to any disclaimer, the term of this patent is extended or adjusted under 35 U.S.C. 154(b) by 375 days.

(21) Appl. No.: 11/231,196

(22) Filed: Sep. 19, 2005

(65) Prior Publication Data

US 2007/0063138 A1 Mar. 22, 2007

(51) Int. Cl.
*H01J 49/40* (2006.01)

(52) U.S. Cl. ..... 250/287; 250/288

(58) Field of Classification Search ..... 250/287
See application file for complete search history.

(56) References Cited

U.S. PATENT DOCUMENTS

| | | | | |
|---|---|---|---|---|
| 5,043,048 | A * | 8/1991 | Muralidhara | 204/518 |
| 5,961,832 | A | 10/1999 | Shaw et al. | |
| 6,774,360 | B2 * | 8/2004 | Guevremont et al. | 250/288 |
| 6,806,463 | B2 | 10/2004 | Miller et al. | |
| 2004/0245458 | A1 | 12/2004 | Sheehan et al. | |

* cited by examiner

*Primary Examiner*—Jack I. Berman
*Assistant Examiner*—James J Leybourne
(74) *Attorney, Agent, or Firm*—Morgan, Lewis & Bockius LLP

(57) ABSTRACT

An ion gate is disposed between a first volume occupied by a first carrier gas and ions of the first carrier gas and a second volume occupied by a second carrier gas. The ion gate includes at least one channel connecting the first volume to the second volume, a first electrode disposed on an inlet surface of the ion gate facing the first volume, and a second electrode disposed on an outlet surface of the ion gate facing the second volume. Ions are transported from the first volume to the second volume through the channel under an electric field produced by the first and second electrode.

20 Claims, 1 Drawing Sheet

ION GATE

BACKGROUND OF THE INVENTION

1. Field of the Invention

The present invention relates to devices and methods for separation of ions from a neutral carrier fluid. More specifically, the invention relates to transfer of ions in a first carrier gas to a second carrier gas.

2. Description of the Related Art

In an application of Field Asymmetric Ion Mobility Spectroscopy (FAIMS), a sample gas is partially ionized and the ions in the ionized gas are separated according to each ion's mobility by application of an asymmetric electric field. In many situations, the neutral molecules or atoms in the carrier gas can reduce the ability of the FAIMS to fractionate the ions and can also contribute to a noise component in the detector electrode. Therefore, there remains a need for devices and methods that can transfer the ions in a first carrier gas to a second carrier gas.

SUMMARY OF THE INVENTION

An ion gate is disposed between a first volume occupied by a first carrier gas and ions of the first carrier gas and a second volume occupied by a second carrier gas. The ion gate includes at least one channel connecting the first volume to the second volume, a first electrode disposed on an inlet surface of the ion gate facing the first volume, and a second electrode disposed on an outlet surface of the ion gate facing the second volume. Ions are transported from the first volume to the second volume through the channel under an electric field produced by the first and second electrodes.

One embodiment of the present invention is directed to a device comprising: a first carrier gas occupying a first volume, the first carrier gas including ions; a second carrier gas occupying a second volume; an ion gate disposed between the first and second volumes, the ion gate including at least one channel allowing ions in the first volume to enter the second volume, a first electrode at a first electric potential disposed on an inlet surface of the ion gate, a second electrode at a second electric potential disposed on an outlet surface of the ion gate, the first and second electric potential providing an electric driving force to transport ions in the first volume to the second volume through the at least one channel. In an aspect of the present invention, the at least one channel is characterized by a channel length that is less than 1 mm. Preferably, the channel length is less than 500 microns, and most preferably the channel length is less than 300 microns. In an aspect of the present invention, the at least one channel is characterized by a channel cross-sectional area that is between 10,000 $\mu m^2$ and 1 $\mu m^2$. Preferably, between 2,500 $\mu m^2$ and 10 $m^2$, and most preferably between 1,000 $\mu m^2$ and 10 $\mu m^2$.

BRIEF DESCRIPTION OF THE DRAWINGS

The invention will be described by reference to the preferred and alternative embodiments thereof in conjunction with the drawings in which.

DETAILED DESCRIPTION

Figure 1:
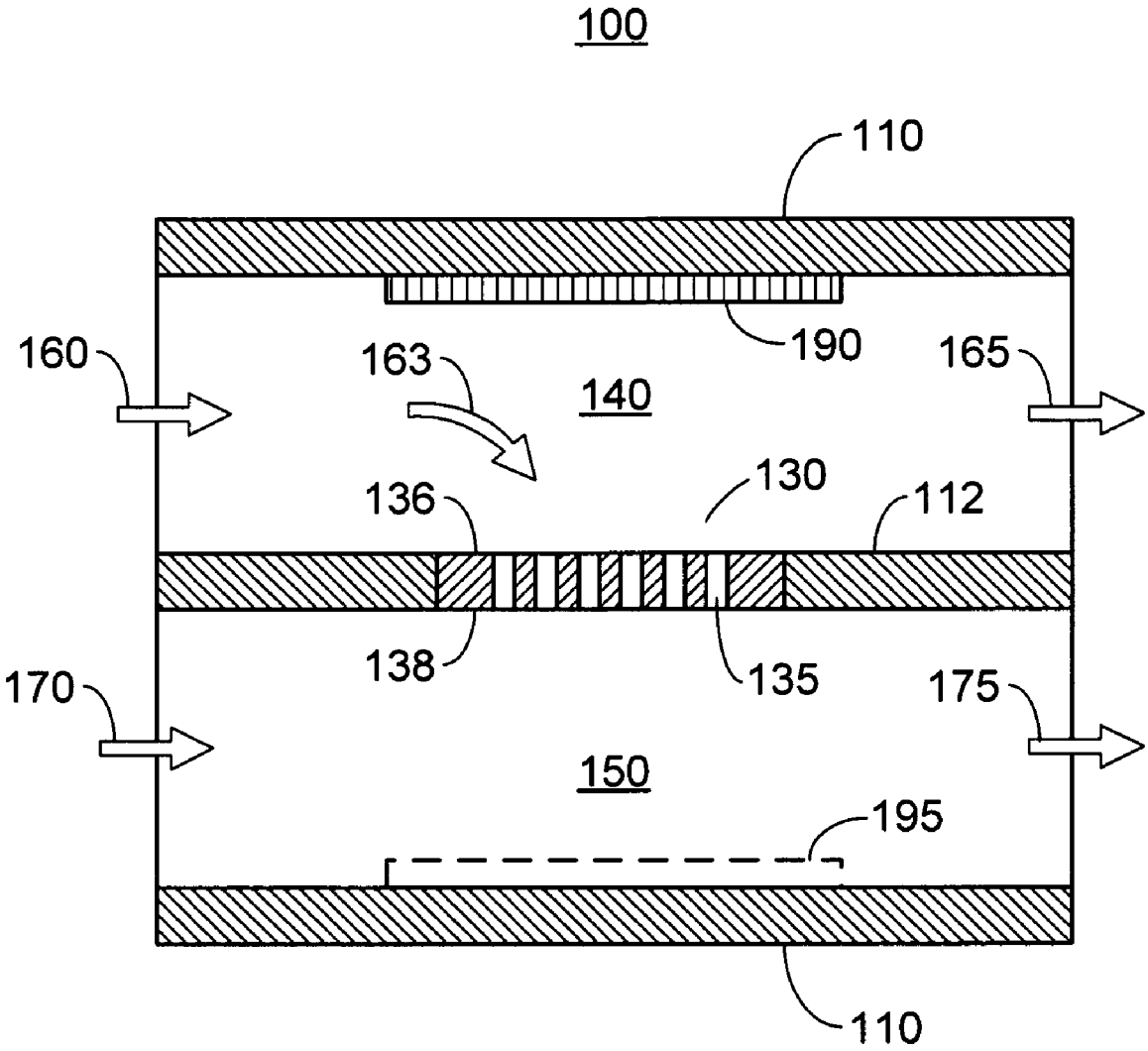
FIG. 1 is a side section view of an embodiment of the present invention.

FIG. 1 is a cross-sectional view of an embodiment of the present invention. Walls 110 define a first volume 140 and a second volume 150 separated by divider 112. Divider 112 includes an ion gate 130 that allows ions to pass from the first volume 140 to the second volume 150 via channels 135. A first electrode 136 is disposed on an inlet surface of the ion gate and a second electrode 138 is disposed on an outlet surface of the ion gate. The ion gate is preferably composed of an insulating or high resistivity material such as, for example, silicon, Pyrex, silica, or quartz. A voltage potential is applied to the first and second electrodes such that ions in the first volume 140 are driven through the channels 135 into the second volume 150. An optional deflector electrode 190 is disposed in the vicinity of the ion gate 130 and an electric potential is applied to the deflector electrode 190 such that ions in the first volume 140 are deflected toward the inlet surface of the ion gate 130. A second optional deflector electrode 195 may be disposed in the second volume in the vicinity of the ion gate 130. The second optional deflector electrode may be biased to collect the ion transported through the ion gate or may be biased to control the potential in the second volume.

In a preferred embodiment, the first volume contains a first carrier fluid and ionized molecules of the first carrier fluid. The second volume contains a second carrier fluid that is preferably different from the first fluid. The fluid may be a liquid or a gas depending on the application of the ion gate. For example, the first and second carrier fluids may be gaseous when the ion gate is used in an ion mobility spectrometer. Alternatively, the first and second carrier fluids may be liquid when the ion gate is used in electrophoresis.

In FIG. 1, ions and a first carrier gas enter the first volume 140 as indicated by arrow 160. The first carrier gas includes neutral molecules and atoms that are sampled from the target environment. Generally, the number of chemical species and their identities in the first carrier gas are unknown. The ions mixed with the first carrier gas are ionized molecules or atoms of the first carrier gas. Ions mixed with the first carrier gas may be directed toward ion gate 130 as illustrated in FIG. 1 by arrow 163. Gas exiting the first volume 140, indicated by arrow 165 include the first carrier gas and preferably a depleted concentration of ions.

In FIG. 1, a second carrier gas enters the second volume 150 as indicated by arrow 170. The concentration and identity of the chemical species in the second carrier gas are preferably known and may be selected such that the chemical species in the second carrier gas do not interfere with downstream analysis of the ions or produce known detection signals that can be distinguished from the signals produced by the ions. Although FIG. 1 shows the first and second carrier gas flowing in the same direction, other configurations such as, for example, the first and second carrier gas flowing in opposite directions are within the scope of the present invention.

In a preferred embodiment, the ion gate is made of a high resistivity material such as, for example, silicon, quartz, silica, or Pyrex. Channels 135 may be manufactured using known MEMS processing methods such as, for example, Deep Reactive Ion Etching (DRIE) or laser drilling. The channel length, or the distance between the first and second volumes, is less than 1 mm, preferably less than 500 microns, and most preferably less than 300 microns. The cross-sectional area of each channel is between 1 $\mu m^2$ and 10,000 $\mu m^2$, preferably between 10 $\mu m^2$ and 2,500 $\mu m^2$, and most preferably between 10 $\mu m^2$ and 1,000 $\mu m^2$. The number of channels may be selected such that the total cross-sectional area of the channels is between 0.01 and 5 $cm^2$ and preferably between 0.1 and 1 $cm^2$.

In some embodiments, the channels may have a rectangular cross-section such as, for example, a slot where the width of the channel is very much smaller than the height of the channel. Other configurations may include a serpentine slot. The width of the slot may be between 1 μm and 100 μm, preferably between 5 μm and 60 μm, and most preferably between 10 μm and 40 μm. The height of the slot may between 10 and 10,000 times the slot width and preferably between 100 and 1,000 times the slot width.

In some embodiments, the second volume may be at a higher pressure relative to the pressure in the first volume. The pressure difference between the first and second volume creates a pressure head across the ion gate that induces a flow from the second volume to the first volume. It is believed that the high fluidic impedance of the ion gate reduces the transport of the second carrier gas into the first volume while still allowing ions in the first volume to be driven by the electrodes into the second volume. The reduction in transport is relative to a single convex channel with a cross section equal to the cumulative cross-sectional areas of the one or more channels in the ion gate.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed:

1. A device comprising:

a first volume occupied by a first carrier fluid, the first carrier fluid including ions;

a second volume occupied a second carrier fluid;

an ion gate disposed between the first and second volumes, the ion gate including at least one channel allowing ions in the first volume to enter the second volume, a first electrode at a first electric potential disposed on an inlet surface of the ion gate, a second electrode at a second electric potential disposed on an outlet surface of the ion gate, the first and second electric potential providing an electric driving force to transport ions in the first volume to the second volume through the at least one channel.

2. The device of claim 1 wherein the at least one channel is characterized by a channel length and the channel length is less than 1 mm.

3. The device of claim 2 wherein the channel length is less than 500 microns.

4. The device of claim 3 wherein the channel length is less than 300 microns.

5. The device of claim 1 wherein the at least one channel is characterized by a channel cross-sectional area and the channel cross-sectional area is between 10,000 $\mu m^2$ and 1 $\mu m^2$.

6. The device of claim 5 wherein the channel cross-sectional area is between 2,500 $\mu m^2$ and 10 $\mu m^2$.

7. The device of claim 6 wherein the channel cross-sectional area is between 1,000 $\mu m^2$ and 10 $\mu m^2$.

8. The device of claim 1 further comprising a deflector electrode, the deflector electrode deflecting ions in the first volume toward the inlet of the ion gate.

9. The device of claim 1 wherein the at least one channel is characterized by a width and a height wherein the width is less than the height.

10. The device of claim 9 wherein the width is between 1 μm and 100 μm.

11. The device of claim 10 wherein the width is between 5 μm and 60 μm.

12. The device of claim 11 wherein the width is between 10 μm and 40 μm.

13. The device of claim 9 wherein the height is between 10 and 10,000 times the width of the channel.

14. The device of claim 1 wherein the at least one channel is formed in a silicon substrate.

15. A method of transporting ions in a first carrier fluid to a second carrier fluid, the method comprising:

providing a channel having a first electrode at a first electric potential disposed on an inlet surface facing the first carrier fluid and a second electrode at a second electric potential disposed on an outlet surface facing the second carrier fluid; and transporting ions in the first carrier fluid through the channel to the second carrier fluid via an electric field generated by the first and second electric potentials.

16. The method of claim 15 wherein the channel is sized to reduce transport of the first carrier fluid through the channel to the second carrier fluid.

17. The method of claim 16 wherein the second carrier fluid is a gas.

18. The method of claim 16 wherein a channel width is between 1 μm and 100 μm.

19. The method of claim 18 wherein the channel width is between 5 μm and 60 μm.

20. The method of claim 19 wherein the channel width is between 10 μm and 40 μm.

* * * * *